US007802345B2

(12) United States Patent
Mathew et al.

(10) Patent No.: US 7,802,345 B2
(45) Date of Patent: Sep. 28, 2010

(54) FOUR-BAR LINKAGE HINGE FOR A MOTOR VEHICLE HOOD

(75) Inventors: Bob George Mathew, West Bloomfield, MI (US); Curtis Scott Hargraves, Clarkston, MI (US); Jeffrey Daniel Krzeszak, Chesterfield, MI (US); Michael James Reeves, Beverly Hills, MI (US); James Chapp, Jr., West Bloomfield, MI (US); Jeffrey Michael McGarry, Flushing, MI (US); Andrew J. Poulios, Royal Oak, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 0 days.

(21) Appl. No.: 12/019,946

(22) Filed: Jan. 25, 2008

(65) Prior Publication Data

US 2009/0188081 A1 Jul. 30, 2009

(51) Int. Cl.
*E05D 15/32* (2006.01)

(52) U.S. Cl. ..... 16/370; 16/371; 296/193.11; 180/69.2

(58) Field of Classification Search ..... 16/366, 16/368, 370, 371, 363, 374, 282, 288, 294, 16/297, 302; 296/76, 193.11, 193.08; 180/69.21, 180/274, 281
See application file for complete search history.

(56) References Cited

U.S. PATENT DOCUMENTS

| | | | | |
|---|---|---|---|---|
| 5,557,829 | A * | 9/1996 | Schoen et al. | 16/375 |
| 6,578,234 | B2 * | 6/2003 | Westerdale | 16/370 |
| 6,618,904 | B1 * | 9/2003 | Nagy | 16/370 |
| 6,736,440 | B1 * | 5/2004 | Hashim et al. | 296/76 |
| 2004/0088826 | A1 * | 5/2004 | Schlegel | 16/366 |
| 2007/0256277 | A1 * | 11/2007 | Shaw | 16/343 |
| 2008/0034552 | A1 * | 2/2008 | Nguyen | 16/375 |

* cited by examiner

*Primary Examiner*—William L. Miller
(74) *Attorney, Agent, or Firm*—Ralph E. Smith

(57) ABSTRACT

A four-bar linkage hinge having a restraining catch arranged to prevent the hinge from opening and translating rearward when said hinge is subjected to an external force causing a transverse deflection of its linkage.

18 Claims, 6 Drawing Sheets

FOUR-BAR LINKAGE HINGE FOR A MOTOR VEHICLE HOOD

FIELD OF THE INVENTION

The present invention relates to an improved four-bar linkage hinge arrangement, and, more particularly, to a restraining device for a four-bar linkage hinge that becomes operational to restrict the hinge from opening in response to a generally transverse deflection of the first bar relative to the second bar of the hinge.

BACKGROUND OF THE INVENTION

A motor vehicle generally has a number of closable and latching exterior aperture covers. The vehicle generally includes a hood to cover the engine and prevent dust and moisture from entering the engine compartment, as well as a lid for the trunk. In order to open the hood or access the trunk, the respective cover generally employs a hinge arrangement, spring assisted or otherwise, designed to assist an operator in lifting and securing one end of the cover in an open position. Typically, single pivot hinge arrangements are used in these applications. Single pivot arrangements, however, can be limited by their construction and/or packaging constraints of a vehicle body. Typically, when a cover equipped with a single pivot hinge is raised, the cover's front portion will rise, while the portion to the rear of the linkage will generally dive, i.e. drop below its starting position. In vehicles with tight packaging constraints, such hinge-imposed motion may result in the rear portion of the cover interfering with other portions of the vehicle body, which is undesirable.

A four-bar linkage hinge provides a solution for dealing with such space-restricted packages. The four-bar linkage hinge has two pivoting bars linking an upper bar which mounts to the cover and a lower bar which mounts to the vehicle body. In operation the four-bar linkage generates a compound motion of rotation and vertical translation. As generally configured for use with a vehicle hood the linkage's compound motion is disproportionate in favor of vertical translation. Such configuration is typically chosen to prevent the portion of the hood to the rear of the linkage from diving below its starting position and into the body structure when the hood is raised. With this type of articulation, however, an angled frontal impact force on the vehicle body may drive the hood rearward and transversely with respect to the vehicle centerline, thereby causing the rear portion of the hinge, and particularly the rear corner of the hood, to lift or move upwardly and translate toward the vehicle's passenger compartment.

It would be desirable to provide a four-bar linkage hinge that can open during regular operation, but whose rear portion would be restrained from lifting up and translating rearward when the linkage is subjected to a transverse deflection.

SUMMARY OF THE INVENTION

The present invention is a four-bar linkage hinge with a catch for restraining its movement in response to a transverse deflecting force. The linkage has a first bar, a second bar, a third bar pivotably connected at a first point to the first bar and at a second point to the second bar, and a fourth bar pivotably connected at a third point to the first bar and at a fourth point to the second bar. The restraining catch is attached to the third bar at a predetermined position between the first point and the second point and arranged to engage the first bar in response to a generally transverse deflection of the first bar relative to the second bar.

The four-bar linkage hinge of the present invention is particularly well suited for mounting an engine compartment cover or hood to a body of a motor vehicle. The four-bar linkage hinge has the first bar for attaching to the hood and the second bar for attaching to the vehicle body. The third bar and the fourth bar pivotably connect the first bar and second bar, thereby facilitating the opening and closing of the hood. The restraining catch is attached to the third bar at a predetermined position whereby, when the hinge is in a closed position, the restraining catch will engage the first bar in response to a generally transverse deflection of the first bar relative to the second bar. Such transverse deflection may result, for example, from an impact on a frontal corner of the hood.

In practice, the restraining catch extends upwardly through an aperture or opening in the upper bracket when the hood is in a closed position and clears the aperture when the hood is opened during the normal operation of the hinge. In the event of a frontal corner impact on the vehicle, transverse movement of the first bar causes the restraining catch to engage the aperture which in turn prevents the hinge from opening and translating the hood rearward.

It should be understood that the detailed description and specific examples which follow, while indicating preferred embodiments of the invention, are intended for purposes of illustration only and are not intended to limit the scope of the invention.

DETAILED DESCRIPTION

In general the present invention is directed to a four-bar linkage hinge with a restraining catch. Although the hinge can have many applications, in practice, it will be described hereinafter with respect to its use and operation in connection with a motor vehicle hood.

Figure 1:
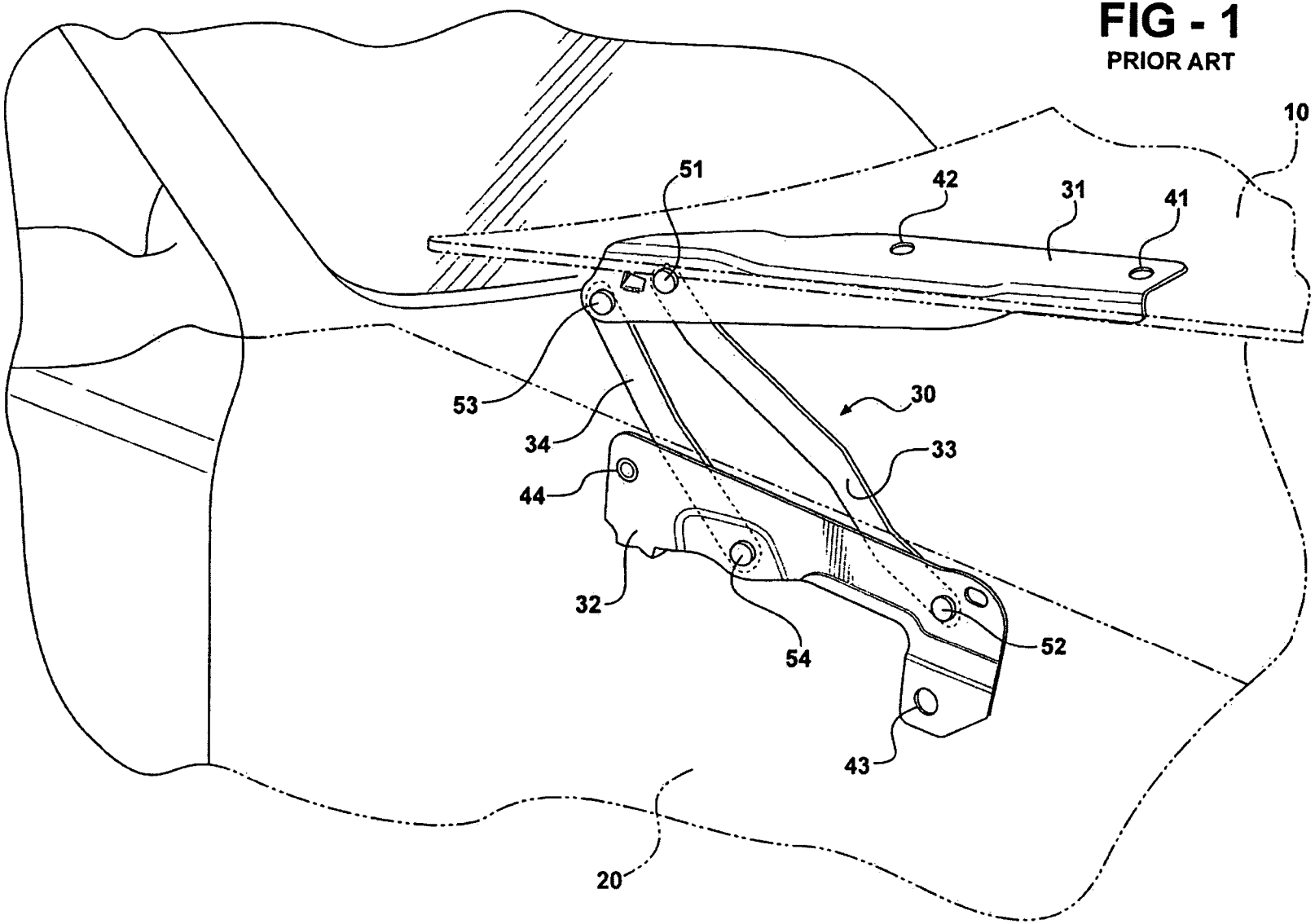
FIG - 1 PRIOR ART
FIG. 1 is a perspective view of a typical four-bar linkage hinge shown in an open position connecting a motor vehicle hood to the vehicle's body according to prior art.

Referring now to the drawings, like elements of the invention are identified with identical reference numerals throughout. FIG. 1 is a perspective view of a typical four-bar linkage hinge according to the prior art shown connecting vehicle hood 10 is attached to vehicle body 20 via four-bar linkage hinge 30. Hinge 30 is comprised of first bar 31 fixed to vehicle hood 10 at points 41 and 42, and second bar 32 fixed to vehicle body at points 43 and 44. Third bar 33 is pivotably connected to first bar 31 at point 51 and to second bar 32 at point 52, and fourth bar 34 is pivotably connected to first bar 31 at point 53 and to second bar 32 at point 54. Hinge 30 is typically fixed to vehicle hood 10 at points 41 and 42 and to vehicle body 20 at points 43 and 44 with threaded fasteners (not shown). Second bar 33 and third bar 34 are typically pivotably connected to bars 31 and 32 with rivets. The four bars comprising four-bar linkage hinge 30 are made from a rigid material, such as steel, to withstand regular loads imposed from opening and closing of a vehicle hood.

Figure 2:
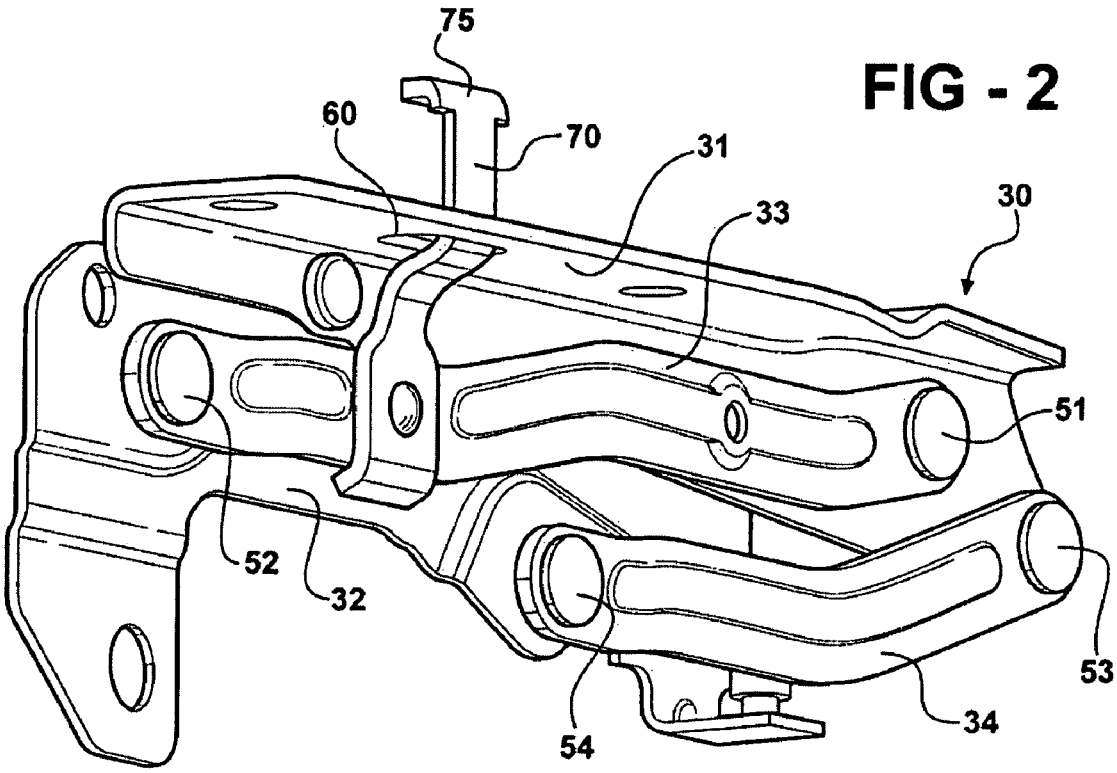
FIG. 2 is a perspective view of a left-hand four-bar linkage hinge in a closed position illustrating a restraining catch according to the invention.
Figure 3:
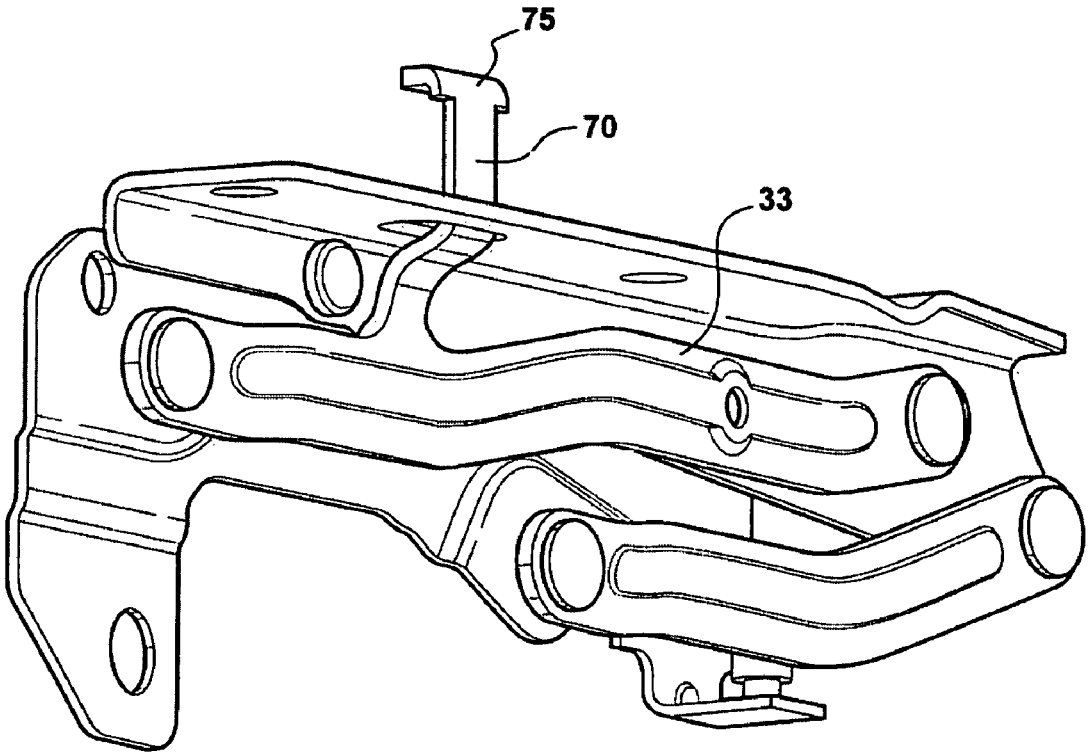
FIG. 3 is a perspective view of the four-bar linkage hinge shown in FIG. 2 wherein the restraining catch and the third bar comprise a unitary structure.
Figure 4:
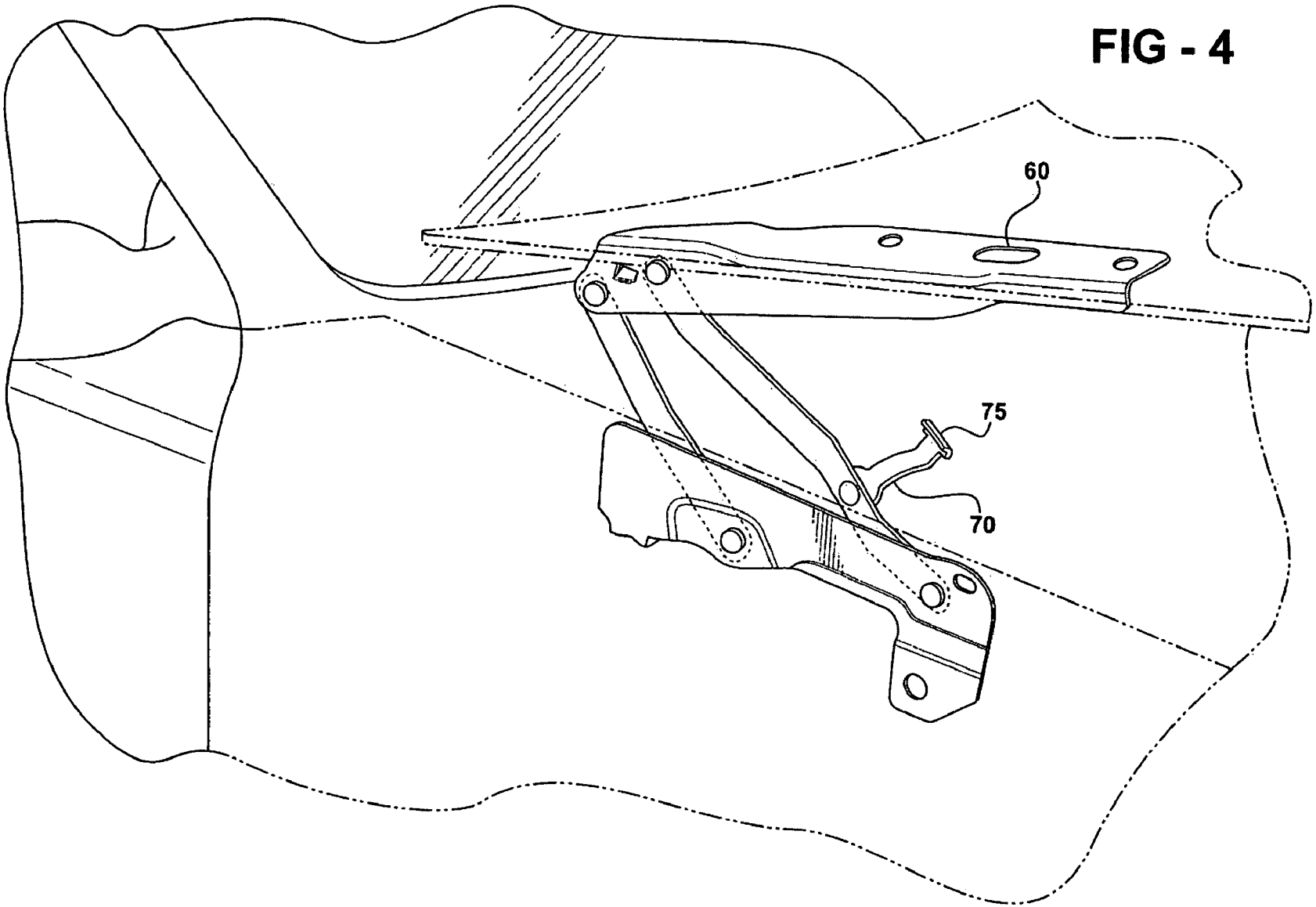
FIG. 4 is a perspective view of the four-bar linkage hinge shown in FIG. 2 in an open position connecting a motor vehicle hood to the vehicle's body.
Figure 5:
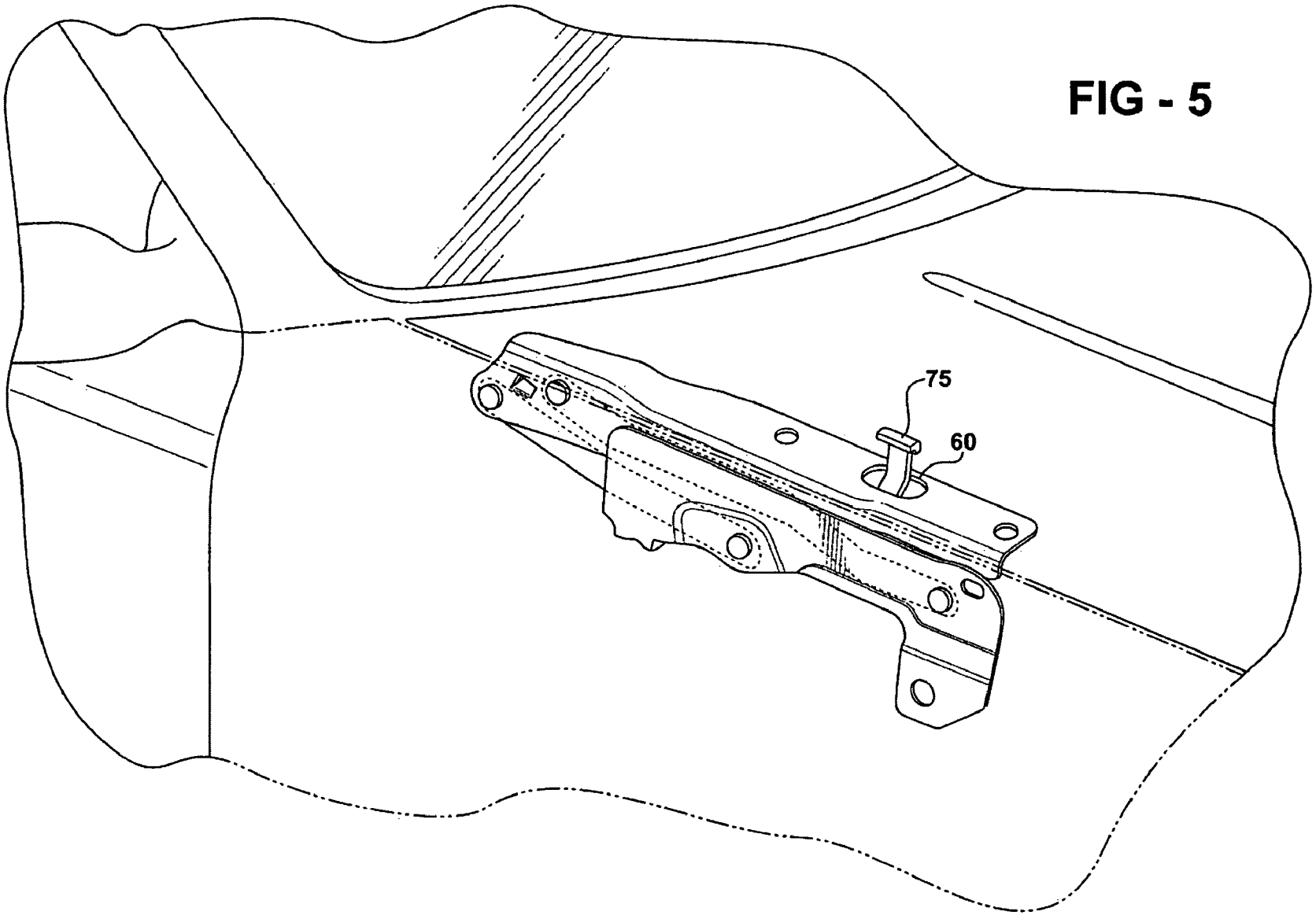
FIG. 5 is a perspective view of a four-bar linkage hinge according to the invention positioned normally within a vehicle body.

Hinge 30 according to the present invention is best seen in FIGS. 2-7. FIG. 2 is a perspective view of hinge 30 in a closed position. Four-bar linkage 30 includes first bar 31 having aperture 60, and third bar 33 having restraining catch 70. Restraining catch 70 may be mounted to third bar 33 with a threaded fastener (not shown) or catch 70 may be integrally formed with bar 33 and comprise a unitary structure (shown in FIG. 3). Restraining catch 70 is an elongated rigid bar preferably made from steel, but may also be made from a reinforced engineering plastic or other high strength material. Restraining catch 70 has a free end terminating in a hooked offset 75 positioned to clear aperture 60 when first bar 31 is vertically aligned relative to second bar 32 during normal operation of opening (FIG. 4) and closing (FIG. 5) of hinge 30.

With a typically configured four-bar linkage hinge 30 as employed in a motor vehicle, a frontal impact force on the corner of the vehicle body that is translated to the vehicle hood can result in significant transverse movement of first bar 31 relative to second bar 32. Such transverse movement may cause the linkage, and with it the rear edge of the hood, i.e. the edge closest to the vehicle's passenger compartment as best seen in FIG. 1, to lift up and translate rearward toward the passenger compartment. When hinge 30 is in the closed position, hooked offset 75 is positioned to engage first bar 31 at aperture 60 in response to a generally transverse deflection of the first bar relative to second bar 32, i.e. in response to a frontal impact on the hood.

Figure 6:
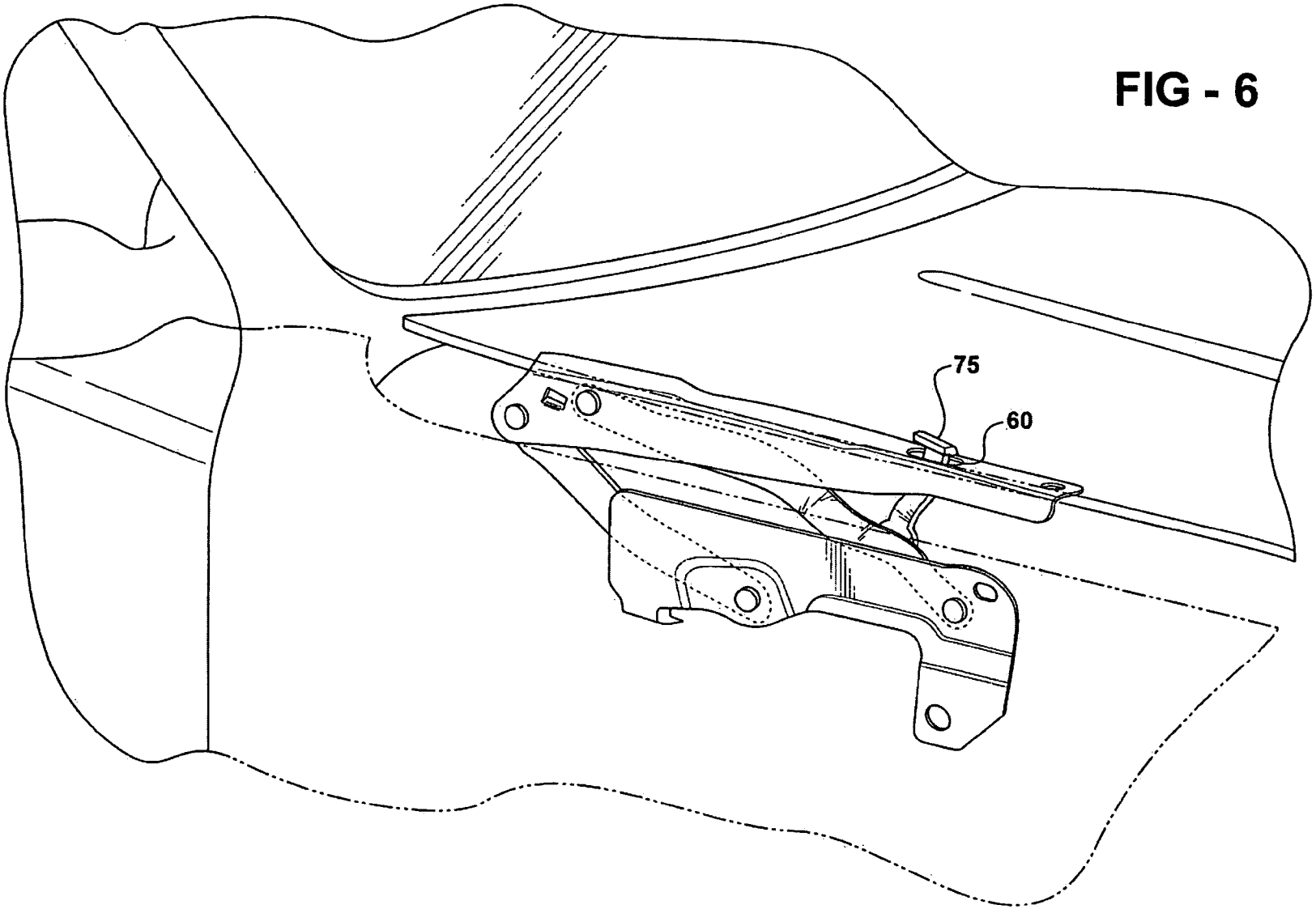
FIG. 6 is a perspective view of the four-bar linkage hinge shown in FIG. 5 wherein the vehicle hood has been deflected transversely and the restraining catch has engaged the aperture.
Figure 7:
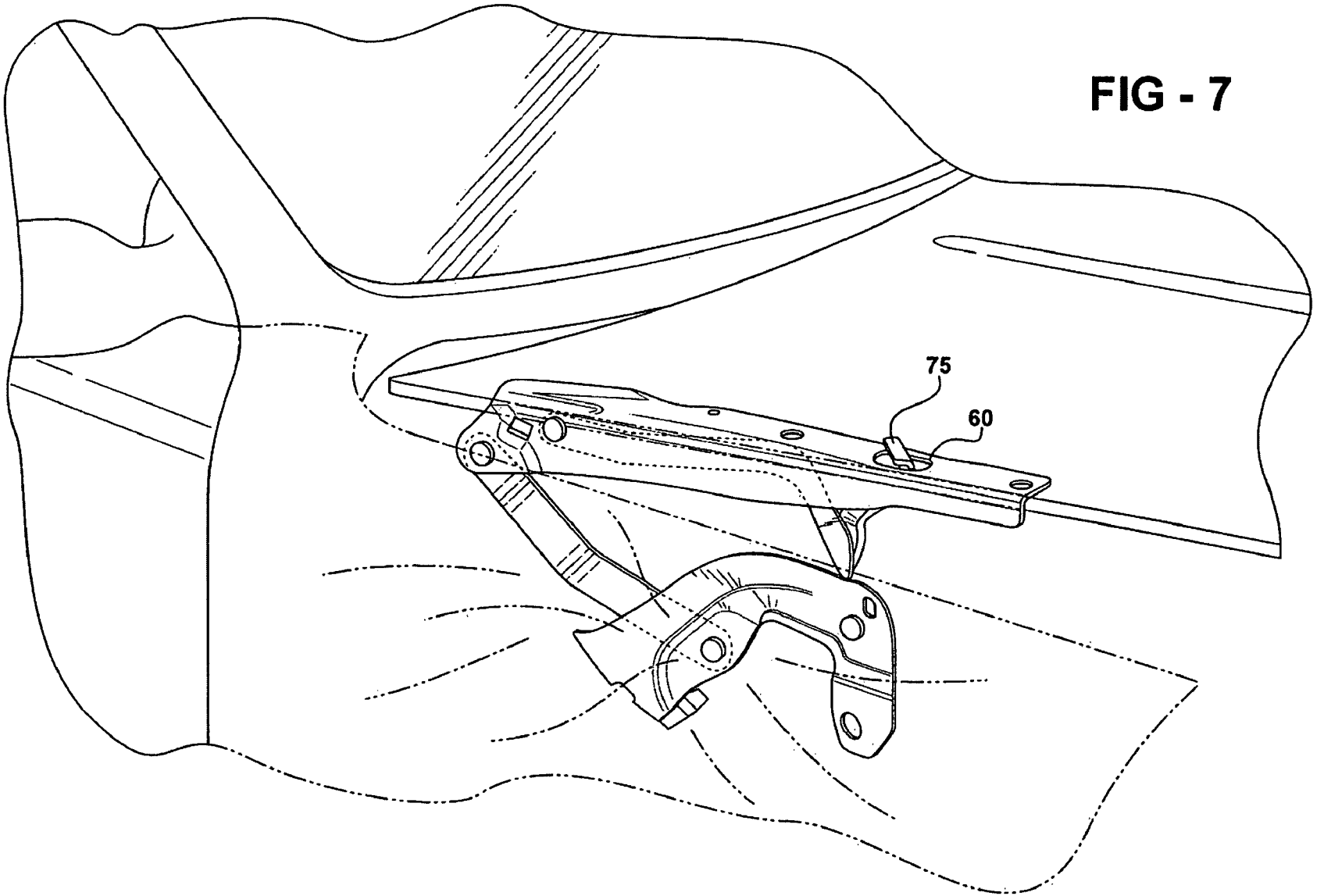
FIG. 7 is a perspective view of the four-bar linkage hinge shown in FIG. 5 wherein the vehicle hood has been deflected transversely with the restraining catch received in the aperture and engaged with the linkage bar in which the aperture is disposed.

As shown in FIGS. 6 and 7, restraining catch 70 engages aperture 60 and thereby prevents the hood's rear portion from lifting up and translating rearward, i.e. first bar 31 and second bar 32 become physically tied together when the first bar is subjected to a transverse deflection relative to the second bar. By engaging aperture 60 with hooked offset 75, restraining catch 70 channels frontal impact forces which might otherwise drive the rear edge of the hood up and rearward toward the passenger compartment into the vehicle's body structure.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A four-bar linkage hinge comprising:

i) a first bar having a lengthwise extent and a second bar having a lengthwise extent extending generally alongside and adjacent the lengthwise extent of the first bar when the hinge is in a closed position;

ii) a third bar pivotably connected at a first point to the first bar and at a second point to the second bar;

iii) a fourth bar pivotably connected at a third point to the first bar and at a fourth point to the second bar, wherein the third point is rearward of the first point and the fourth point is rearward of the second point; and iv) a restraining catch attached to the third bar at a predetermined position between the first point and the second point, and comprised of a hooked offset arranged to engage the first bar in response to a generally transverse deflection of the first bar relative to the second bar when the hinge is in the closed position.

2. The four-bar linkage hinge of claim 1 wherein the restraining catch is comprises an elongated rigid bar terminating in the hooked offset positioned to clear an aperture in the first bar during normal operation of the hinge and engage the aperture in response to the generally transverse deflection of the first bar relative to the second bar when the hinge is in the closed position.

3. The four-bar linkage hinge of claim 1 wherein the restraining catch is metal.

4. The four-bar linkage hinge of claim 1 wherein the restraining catch is reinforced engineering plastic.

5. The four-bar linkage hinge of claim 1 wherein the restraining catch is integrally formed with the third bar and comprises a unitary structure.

6. The four-bar linkage hinge of claim 1 wherein the restraining catch is comprised of a bar extending outwardly from the third bar generally perpendicular to the third bar and wherein the hooked offset comprises a T-shaped hooked offset receivable in a recess in the first bar when the hinge is in the closed position with the T-shaped hooked offset configured to engage the first bar in response to generally transverse deflection of the first bar relative to the second bar when the hinge is in the closed position physically tying the first bar and second bar together.

7. The four-bar linkage hinge of claim 1 wherein the restraining catch further comprises a bar having the hooked offset removably received in a clearance in the first bar when the hinge is in the closed position.

8. The four-bar linkage hinge of claim 7 wherein the clearance comprises an aperture formed in the first bar.

9. A motor vehicle body having a four-bar linkage hinge for mounting an engine compartment hood to the body, the four-bar linkage hinge comprising:

i) a first bar having a longitudinal axis and a second bar having a longitudinal axis;

ii) a third bar pivotably connected at a first point to the first bar and at a second point to the second bar;

iii) a fourth bar pivotably connected at a third point to the first bar and at a fourth point to the second bar, wherein the third point is rearward of the first point and the fourth point is rearward of the second point;

iv) a restraining catch attached to the third bar at a predetermined position between the first point and the second point, and comprising a T-shaped hooked offset arranged to engage the first bar in response to a generally transverse deflection of the first bar relative to the second bar as a result of an impact on a frontal corner of the hood when the hood is in a closed position; and wherein the longitudinal axes of the first and second bars are generally parallel and adjacent when the hood is in the closed position.

10. The four-bar linkage hinge of claim 9 wherein the restraining catch comprises an elongated rigid bar extending from the third bar and terminating in the T-shaped hooked offset positioned to clear an aperture in the first bar during normal operation of the hinge and engage the aperture in response to the generally transverse deflection of the first bar relative to the second bar when the hood is in the closed position.

11. The four-bar linkage hinge of claim 9 wherein the restraining catch is metal.

12. The four-bar linkage hinge of claim 9 wherein the restraining catch is integrally formed with the third bar and comprises a unitary structure.

13. The four-bar linkage hinge of claim 9 wherein the first bar has a generally L-shaped cross section having an elongate aperture with the T-shaped hooked offset comprising an enlarged portion of an elongate bar extending through the elongate aperture in the first bar when the hood is in the closed position.

14. The four-bar linkage hinge of claim 9 wherein the restraining catch further comprising of a bar extending outwardly from the third bar having the T-shaped hooked offset generally perpendicular to the third bar.

15. The four-bar linkage hinge of claim 9 wherein the restraining catch further comprises a bar having the T-shaped hooked offset removably received in an aperture formed in the first bar when the hood is in the closed position.

16. A four-bar linkage hinge comprising:

i) a first bar having a lengthwise extent and a second bar having a lengthwise extent extending generally alongside and adjacent the lengthwise extent of the first bar when the hinge is in a closed position;

ii) a third bar pivotably connected at a first point to the first bar and at a second point to the second bar;

iii) a fourth bar pivotably connected at a third point to the first bar and at a fourth point to the second bar, wherein the third point is rearward of the first point and the fourth point is rearward of the second point; and iv) a restraining catch extending outwardly from the third bar between the first point and the second point that comprises a hook receivable in a clearance in the first bar when the hinge is in the closed position with the hook configured to engage the first bar in response to a generally transverse deflection of the first bar relative to the second bar when the hinge is in the closed position physically tying the first bar and second bar together.

17. The four-bar linkage hinge of claim 16 wherein the clearance comprises an aperture formed in the first bar through which a portion of the restraining catch extends when the hinge is in the closed position.

18. The four-bar linkage hinge of claim 16 wherein the restraining catch further comprises an elongate bar extending outwardly from the third bar generally transversely relative to the third bar and wherein the hook comprises a hooked offset formed in the elongate bar.

* * * * *